US005907944A

United States Patent [19]

Giacoman

[11] Patent Number: 5,907,944

[45] Date of Patent: Jun. 1, 1999

[54] FOOD PACKAGING ENCLOSING REMOVABLE PRIZE

[76] Inventor: Rodolfo Gerardo Murra Giacoman, 149 N. Concepción, El Paso, Tex. 79905

[21] Appl. No.: 08/851,710

[22] Filed: May 6, 1997

[51] Int. Cl.[6] ..... B65B 11/50; B65B 61/20

[52] U.S. Cl. ..... 53/450; 53/135.3; 53/238; 53/415; 53/474

[58] Field of Search ..... 53/430, 445, 474, 53/415, 135.3, 238, 239, 157, 155, 591

[56] References Cited

U.S. PATENT DOCUMENTS

| | | | |
|---|---|---|---|
| 1,879,952 | 9/1932 | Rosen . | |
| 2,093,985 | 9/1937 | Stansbury . | |
| 2,240,072 | 4/1941 | Hodgdon et al. . | |
| 2,260,064 | 10/1941 | Stokes | 53/415 |
| 2,420,045 | 5/1947 | Krug . | |
| 2,475,359 | 7/1949 | Piazze . | |
| 2,624,294 | 1/1953 | Seagren . | |
| 2,736,656 | 2/1956 | Marshall . | |
| 2,917,164 | 12/1959 | Kehr | 206/47 |
| 3,147,856 | 9/1964 | Lightner et al. | 206/47 |
| 3,155,234 | 11/1964 | Knoll et al. | 206/47 |
| 3,159,930 | 12/1964 | Allen et al. . | |
| 3,183,614 | 5/1965 | Loderhose . | |
| 3,229,442 | 1/1966 | Gram . | |
| 3,419,400 | 12/1968 | Hayhurst et al. | 99/171 |
| 3,443,682 | 5/1969 | Niemeyer | 206/47 |
| 3,524,271 | 8/1970 | Buske . | |
| 3,524,782 | 8/1970 | Buske . | |
| 3,606,135 | 9/1971 | Rosenberg, Jr. . | |
| 3,625,412 | 12/1971 | Rosenburg, Jr. | 229/39 |
| 3,762,628 | 10/1973 | Sargent | 229/56 |
| 3,805,483 | 4/1974 | Romagnoli . | |
| 4,020,614 | 5/1977 | Smithers . | |
| 4,024,694 | 5/1977 | Cooper et al. | 53/282 |
| 4,060,168 | 11/1977 | Romagnoli | 206/216 |
| 4,103,820 | 8/1978 | Mathison et al. | 229/37 R |
| 4,306,367 | 12/1981 | Otto | 40/312 |
| 4,308,679 | 1/1982 | Ray, III et al. | 40/312 |
| 4,324,823 | 4/1982 | Ray, III | 428/43 |
| 4,345,393 | 8/1982 | Price et al. | 40/312 |
| 4,544,590 | 10/1985 | Egan | 428/40 |
| 4,726,171 | 2/1988 | Kreager | 53/474 X |
| 4,797,291 | 1/1989 | Pierce et al. | 426/63 |
| 4,841,712 | 6/1989 | Roou | 53/430 X |
| 4,897,273 | 1/1990 | Kotaki et al. | 53/474 X |
| 4,917,247 | 4/1990 | Jud | 206/610 |
| 4,988,110 | 1/1991 | Zuckerman et al. | 273/286 |
| 5,009,518 | 4/1991 | Faltynek | 383/106 |
| 5,051,268 | 9/1991 | Mally | 426/420 |
| 5,119,940 | 6/1992 | Grindrod | 206/45.31 |
| 5,150,560 | 9/1992 | Crowley | 53/430 X |
| 5,209,349 | 5/1993 | Porter et al. | 206/232 |
| 5,282,534 | 2/1994 | Lapp | 206/232 |
| 5,284,667 | 2/1994 | Zimmerman et al. | 426/420 |
| 5,363,966 | 11/1994 | Czech et al. | 206/554 |

*Primary Examiner*—James F. Coan
*Attorney, Agent, or Firm*—Staas & Halsey

[57] ABSTRACT

Food packaging with a removable prize therein, and a related method of manufacturing the packaging. Prizes are deposited at a predetermined spacing along an adhesive-coated first surface of a first sheet of plastic wrapping. The first surface of the first sheet of plastic wrapping with the prizes adhered thereon is covered by a second sheet of plastic wrapping. A second surface of the first sheet, opposite the first surface, is covered by a third sheet of plastic wrapping, after food is placed between the first sheet and the third sheet.

9 Claims, 6 Drawing Sheets

FOOD PACKAGING ENCLOSING REMOVABLE PRIZE

BACKGROUND OF THE INVENTION

1. Field of Invention

This invention relates to packaging and, more particularly, to plastic sheet food packaging enclosing a removable prize, and a related method of manufacture.

2. Background Art

Currently, food processors that wish to include prizes with food items, such as potato chips or candy: (1) affix the prize to the outside of plastic wrap food packaging, subjecting the prize to loss or theft; (2) merely insert such prizes loosely inside the food packaging by hand, which is labor intensive, and which is unsanitary since the prize co-mingles with the food item; or (3) simply forego including such items inside the plastic wrap for want of an efficient and/or sterile way to do so.

More particularly, the food packaging industry has attempted to incorporate prizes with food packaging in the following manners.

U.S. Pat. No. 3,762,628, issued to Sargent, discloses a method for producing a bag with a separate interior compartment for holding a coupon. Each coupon is separated from a parent roll of coupons and is then placed in spaced relation between two sheets of flexible transparent thermoplastic material unwound from rolls, one of the sheets being folded over on itself. The bag is sealed on three sides, and food can be placed directly in the bag through the unsealed side, and this side is then sealed. Again, the coupons and the food can co-mingle, causing an unsanitary condition. Also, this method appears best suited for flat items only. Finally, the coupon is not made a part of the packaging per se, but is merely placed in a compartment or bag separate from the outer layers of the packaging, which does not lead to the best protection of the coupon.

U.S. Pat. No. 2,917,164, issued to Kehr, discloses an open food bag with a pouch for containing a gift, such as a baseball card. The pouch prevents the gift from directly contacting the food within the bag.

U.S. Pat. No. 5,009,518, issued to Faltynek, discloses a bag with an external window style pocket containing a removable coupon.

U.S. Pat. No. 5,363,966, issued to Czech et al., also discloses a series of plastic bags, each with an external panel containing a removable coupon.

U.S. Pat. No. 3,443,682, issued to Niemeyer, discloses a carton having an internal pocket made from a flexible material to hold a coupon or some other printed matter. Again, flat objects only appear to be the intended prize.

U.S. Pat. No. 4,306,367, issued to Otto, relates to a laminated food packaging carton having a removable outer ply that may be a coupon, an "iron-on", trading stamp, or some other type of merchandising premium.

Again, as long as the prize item is placed on the exterior of the food packaging, there is a chance that the item will be stolen or otherwise removed.

U.S. Pat. Nos. 3,524,782 and 3,524,271, issued to Buske, disclose coupons attached, via a pressure sensitive adhesive, to a strip which is wound into a roll. The strip is cut into individual labels which may be attached to the outer surface of a container. The labels can each be opened by tearing along perforations for access to the coupons. Again, as with Sargent, described above, it appears that this method is best suited for flat objects only. Also, as the labels are applied to the outside of the container, theft is still a problem. Moreover, the coupon is not made a part of the packaging per se, but is formed as a separate member and merely attached to the exterior of the package.

U.S. Pat. No. 4,060,168, issued to Romagnoli, like the Buske references discussed above, discloses a strip or web of backing material with a series of printed labels arranged thereon in serial order. The backing material includes a die cut portion opposed to the label which remains adhered to the label upon application of the label to an exterior of a container. The cut portion may include printing and serves as a promotional item with improved pilfer resistance. Again, this type of method appears related to enclosing flat items only. Also, the label is not incorporated in the packaging per se.

Although the prior art described above eliminates some of the problems inherent in the food packaging with prize art, this prior art still does not disclose or teach packaging or a related method, wherein a prize, such as a small toy, is efficiently incorporated directly in the packaging, so that a sanitary condition of the food is preserved.

SUMMARY OF THE INVENTION

Accordingly, it is a purpose of the present invention to provide food packaging with a prize, which packaging is more sterile than prior art packages.

It is another purpose of the present invention to provide food packaging with a prize, wherein the prize is less susceptible to theft or loss than with prior art packaging.

It is another purpose of the present invention to provide food packaging with a prize inside the packaging, but separated from the food by a plastic sheet, to prevent co-mingling and contamination of the food by the prize.

It is another purpose of the present invention to provide an automated method for incorporating a prize in food packaging.

It is another purpose of the present invention to provide a method for manufacturing food packaging, including a prize, which method is more efficient than prior art methods.

It is another purpose of the present invention to provide an efficient and sterile method using conventional, automated packaging machinery to incorporate a prize with plastic wrapped food products.

It is another purpose of the present invention to provide a more efficient and sterile method for manufacturing food packaging with a prize therein.

It is still another purpose of the present invention to provide a method which incorporates a prize with plastic wrap food products that deters theft or loss of the prize.

Finally, it is a purpose of the present invention to provide a manufacturing method which allows a variety of prizes, including non-flat articles, to be incorporated between plastic sheets which make up the food packaging.

To achieve the foregoing and other purposes of the present invention there is provided food packaging with a removable prize therein, and a related method of manufacturing this packaging. Prizes are deposited at a predetermined spacing along an adhesive coated first sheet of plastic wrapping. The surface of the first sheet of plastic wrapping with the prizes adhered thereon is covered by a second sheet of plastic wrapping, and the opposing surface of the first sheet is covered by still a third sheet of plastic wrapping, once food is placed between the first sheet and the third sheet. Thus, prizes may be included in an efficient and sterile manner in food packaging having the second and third sheets as the outer walls of the packaging.

Other features and advantages of the present invention will be apparent from the following description taken in conjunction with the accompanying drawings, in which like reference characters designate the same or similar parts throughout the figures thereof.

BRIEF DESCRIPTION OF THE INVENTION

The accompanying drawings, which are incorporated in and constitute a part of the specification, illustrate embodiments of the invention and, together with the description serve to explain the principles of the invention.

DESCRIPTION OF THE PREFERRED EMBODIMENTS

The food packaging and the method for manufacturing the packaging according to the present invention will now be described in detail with reference to FIGS. 1–7.

Figure 1:
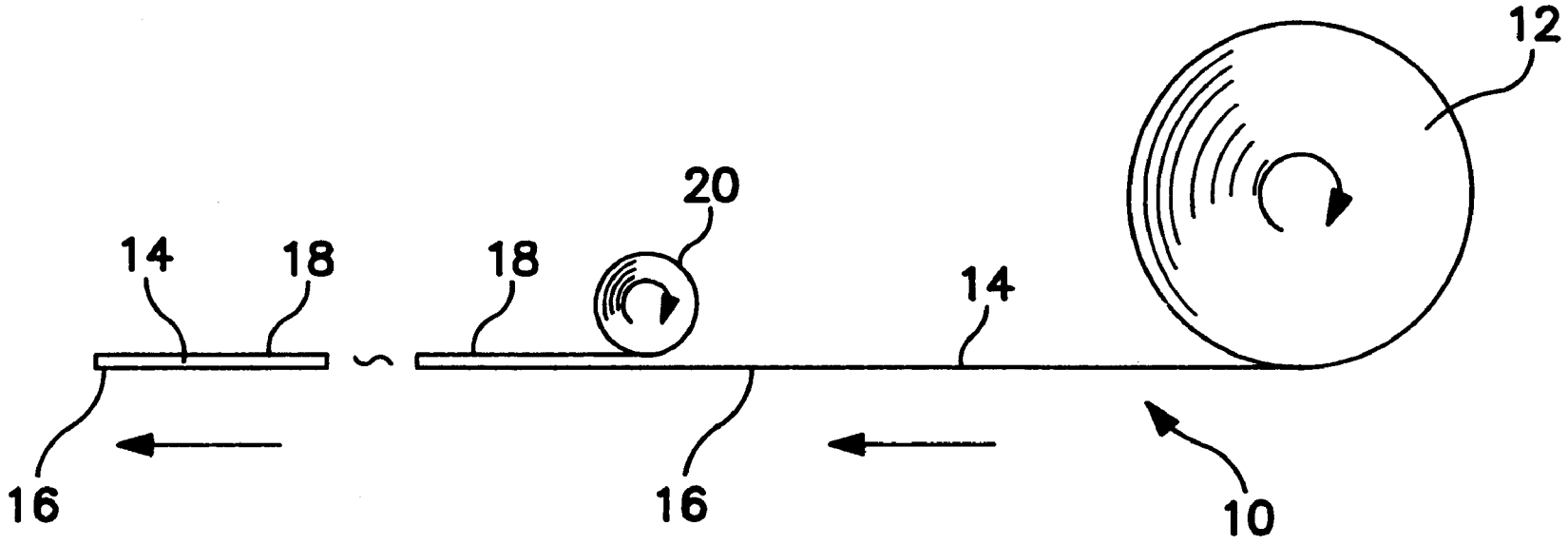
FIG. 1 is a schematic view illustrating a first sheet of plastic wrap being unrolled and having adhesive coated on one surface thereof, according to the present invention.

The method comprises generally the following steps. As shown in FIG. 1, a first plastic sheet material 10 is unwound from a roll 12 and fed along a work station. This first plastic sheet material 10, as well as the second and third plastic sheet materials described below, are preferably polypropylene.

The first plastic sheet material 10 has a first, upper surface 14 and a second, opposite surface 16. An adhesive layer 18 is formed on the first surface 14 by a known applicator 20 capable of applying the adhesive layer 18 from, e.g., a roll supply. The adhesive layer 18 may either entirely or only partly cover the first surface 14 of the first sheet material 10, as desired.

In the preferred embodiment, the adhesive layer 18 is a double sided, FDA approved, water-based, adhesive (as opposed to a solvent based adhesive), to prevent contamination of the food. In the final product, i.e., the completed package 54 described below, the adhesive 18 would be clear to allow easy viewing of the prize and to avoid any unsightly effect for the consumer.

It is preferred that the adhesive layer 18 be applied to the first surface 14 of the first sheet material 10 from above, especially if the adhesive is in a liquid form. In this way, the sheet material 10 is supported underneath by the workstation to facilitate application and adhesion of the adhesive layer 18.

Figure 2:
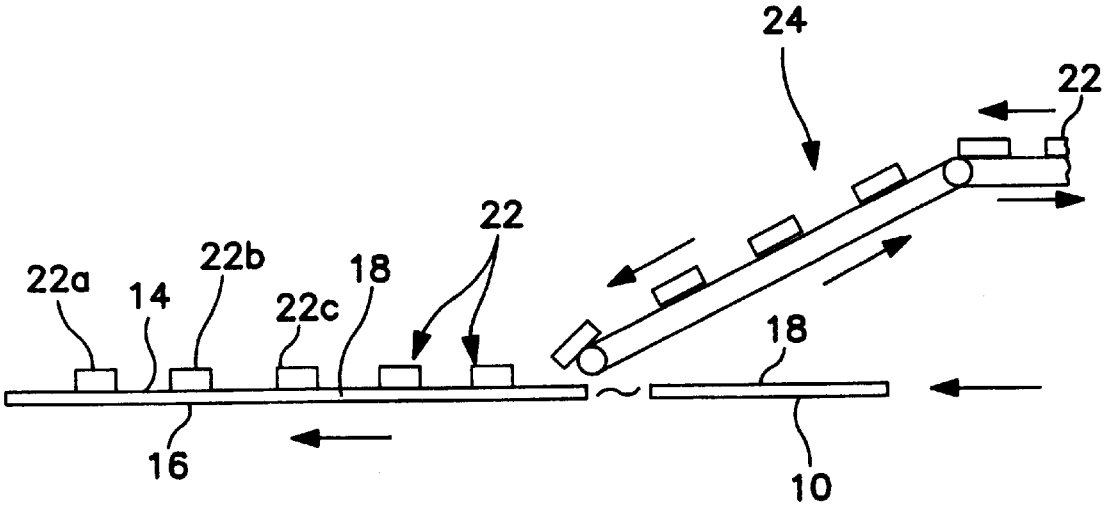
FIG. 2 is a schematic view illustrating the first sheet of plastic wrap having prizes applied to the adhesive coating.

As shown in FIG. 2, after the adhesive layer 18 is applied, a plurality of prizes 22 (each denominated 22*a*, 22*b*, and so on) is positioned in spaced relation on top of the adhesive layer 18.

The term "prize" as used herein is intended to mean any of a number of food, novelty or print items, such as gum, candy, pens, cards, coupons, certificates, small toys, iron-on transfers, etc. These prizes 22 can serve as promotional items in association with the sale of a food product.

It is preferred that the prizes 22 be applied to the adhesive layer 18 from above. In this way, the adhesive layer 18 and the sheet material 10 are supported underneath by a workstation, to facilitate application and adherence of the prizes 22.

The positioning of the prizes 22 can be performed by, e.g. any known apparatus 24 capable of such function, such as a conveyor feed or pick and place device. The spacing between prizes 22 is dependent upon where transverse seams, described below, will be formed to create individual packages (by cutting at the seams), and upon how many prizes 22, if more than one, will be in each individual package.

Figure 3:
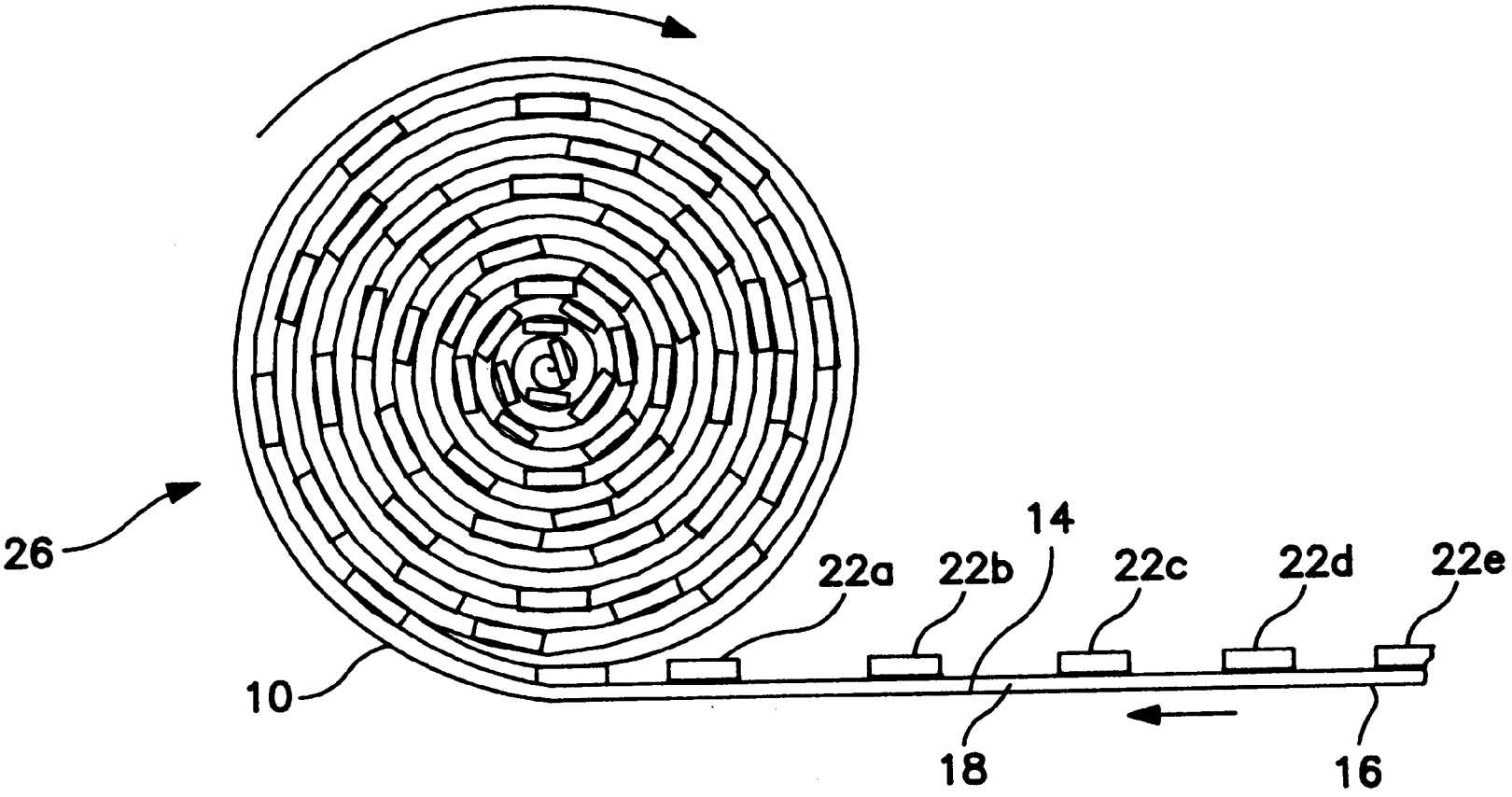
FIG. 3 is a schematic view illustrating the first sheet of plastic wrap, with the prizes adhered thereto, wound into a roll.

As shown in FIG. 3, the first sheet material 10, with the spaced prizes 22 thereon, can be rolled up, which roll is referred to herein as a "plastic prize roll" 26. This plastic prize roll 26 can be removed from the assembly line and stored for a period of time, if desired, before moving on to the next assembly step, either in the same line, or the separate, remote line of a food processor.

Regardless of whether a plastic prize roll 26, such as shown in FIG. 3, is utilized or not (wherein the method would be continuous), the next step in the method is described below.

Figure 4:
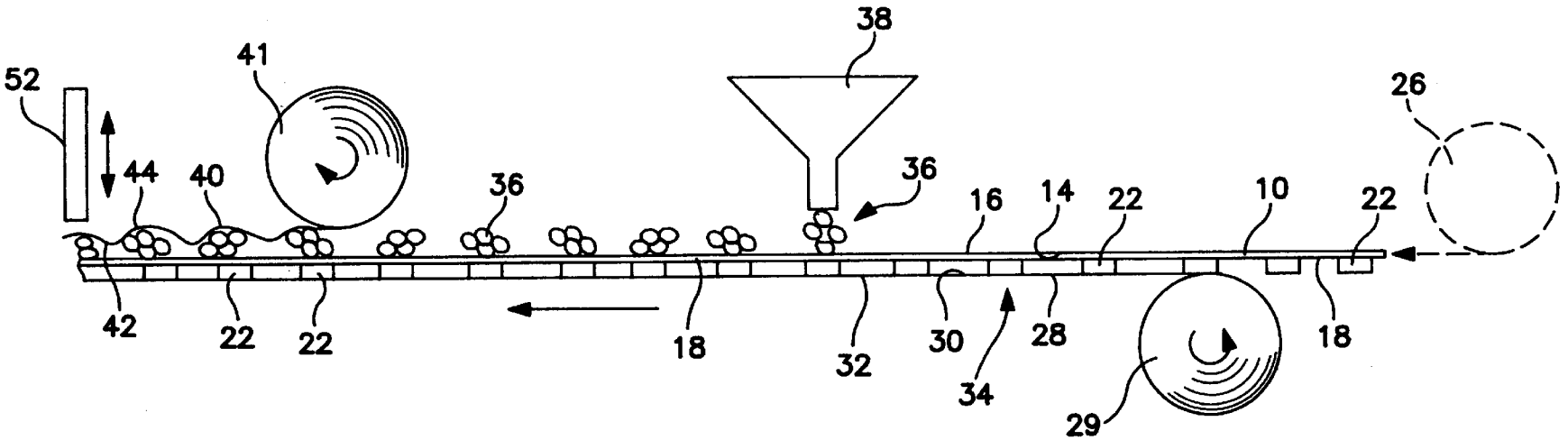
FIG. 4 is a schematic view illustrating the roll being unwound and combined with second and third plastic sheets to form the packaging.
Figure 5:
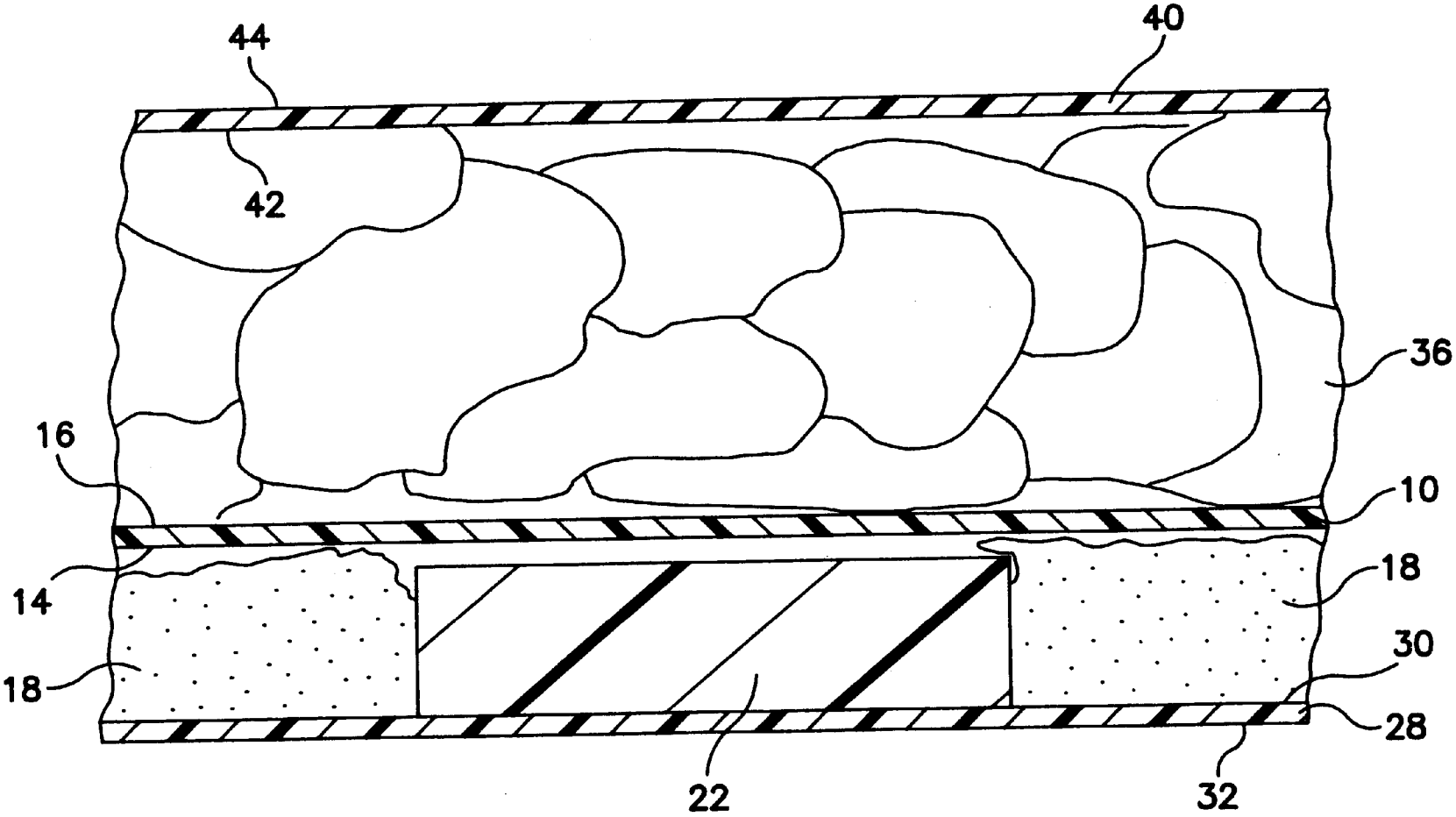
FIG. 5 is a side, cross-sectional view illustrating the combined packaging with food and the prize therein.

As shown in FIG. 4, the first plastic sheet material 10 with the prizes 22 thereon is inverted (relative to FIG. 3) and fed along a workstation. The inversion is for the purpose of orienting the prizes 22 opposite food 36 which is dispensed from above, as described below.

A second plastic sheet material 28 or "flow pack", which may include advertising and/or other indicia thereon, is also fed along this workstation from a supply 29. The second sheet material 28 also has a first surface 30, and a second opposite surface 32. The first surface 30 of the second sheet material 28 adheres to the first sheet material 10 via the adhesive layer 18, with the prizes 22 therebetween, to form a first and second sheet material combination 34.

Thus, it is preferred to apply the adhesive 18, prize 22, and food 36 from above. To do this, the plastic prize roll 26 is inverted so that the second sheet material 28 can be applied from below. Then, the food 36 and third sheet 40 are applied from above, as shown in FIG. 4. Alternatively, when the second 28 and third 40 sheet material are from the same plastic sheet, as discussed below, the food 36 is applied to the first sheet material 10 from above, and the second sheet 28 is folded on top of the food and sealed.

The first sheet material 10 can be as wide as, i.e., co-terminous with, the second sheet material 28 (and the third sheet material 40 described below), but does not have to be. That is, the first sheet material 10 need only be wide enough to cover the prize 22 and provide lateral edges therearound to allow for adhering the first sheet material 10 to the second sheet material 28, in a way that isolates the prize from the food 36, as discussed below.

The combination 34 can be wound at this point, much like the plastic prize roll 26, removed from the assembly line, and stored. In this way, the combination 34 could be used at a later time in the method, which option facilitates automated assembly, line flexibility and changeovers, and allows better inventory control.

Regardless of whether the combination 34 is rolled and stored at this time, or not, the next step in the method is described below.

As the combination 34 is fed along a workstation, food 36 is dispensed, in spaced relation, onto the second surface 16 of the first sheet 10 by a known dispenser 38. The food 36, like the prizes 22 discussed above, is spaced based on where the transverse seams and cuts will be made to form individual food packages, as described below.

After the food 36 is individually dispensed, preferably a third separate plastic sheet material 40 or flow pack, which also may have advertising and/or other indicia thereon, is applied over the food 36 from a supply 41. More particularly, the third sheet material 40 has a first surface 42 and a second surface 44. The first surface 42 is placed on the food 36, over the prizes 22, and contacts the second surface 16 of the first sheet material 10. The lateral edges of the third sheet 40 are preferably co-terminus with the lateral edges of the second 28 sheet material. The overall combination is shown in the side, cross-sectional view of FIG. 5.

Figure 6:
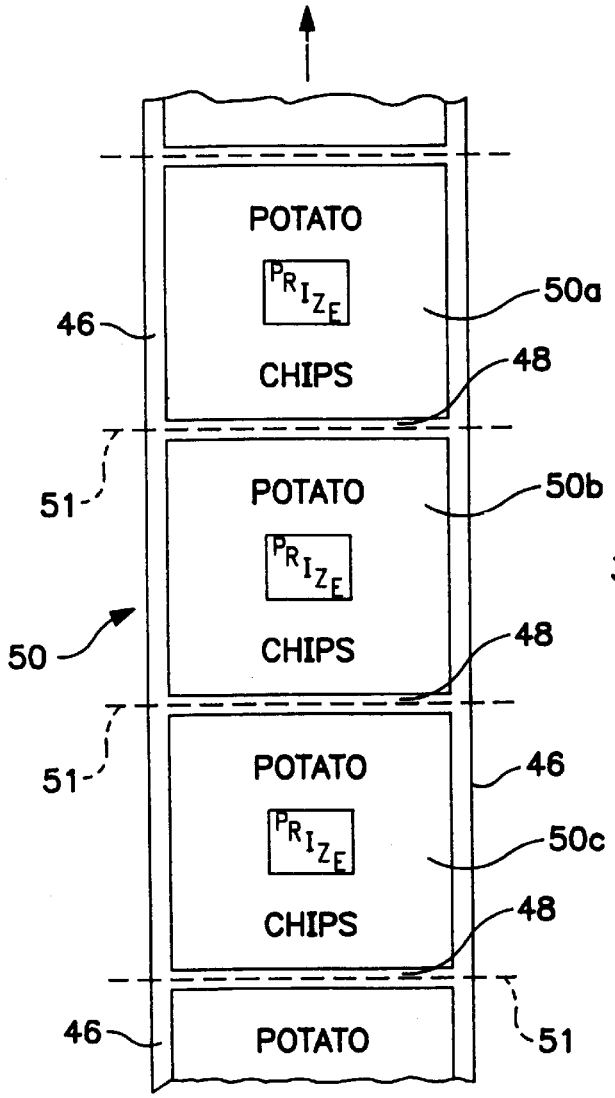
FIG. 6 is a top view of the connected food packages.

Then, as shown in FIG. 6, the first 10, second 28 and third sheet 40 materials are sealed at the lateral or longitudinal edges 46 and transverse areas 48 thereof to form a plurality of compartments 50 (each referred to as 50*a*, 50*b*, etc.) connected as a continuous web. This sealing is performed by one of many conventional means 52 (FIG. 4), such as heat sealing or adhesive.

More particularly, the two outer flow pack sheets (28, 40) are sealed according to currently known techniques: for some currently available packaging equipment the flow pack sheets are sealed by heat sealing or adhesive, but in other types of equipment, the flow pack sheets 28, 40 are actually just the sheet 28 which is folded over on itself and similarly sealed. Accordingly, the present invention contemplates the flow packs 28, 40 being individual sheets or being the same sheet, folded over the prize roll/dispensed food to form "sheets" 28, 40, along the edge thereof, sealed and cut.

Then, the plurality of compartments 50 is cut at 51 into individual packages 54 at the seamed transverse areas 48.

As can be seen, the use of a plurality of plastic sheets leads to an efficient method for incorporating the prize inside the packaging, during manufacturing thereof. Also, along the assembly line, the sheets can be rolled up and stored for a period of time, which allows greater assembly flexibility, inventory control, cost containment, etc.

Further, the automated assembly of the present method invention allows the use of conventional plastic web and sealing equipment. Accordingly, there is no need for significant capital outlay for new equipment custom designed for the new packaging.

Moreover, the method herein is adaptable to a variety of prizes, flat or non-flat, as long as each can be adhered within sheet-like plastic material. In this way, the assembly line is provided with significant flexibility, as one type of prize can be produced for a period of time, and then the line can be switched, without much modification, to use another prize, etc.

Figure 7:
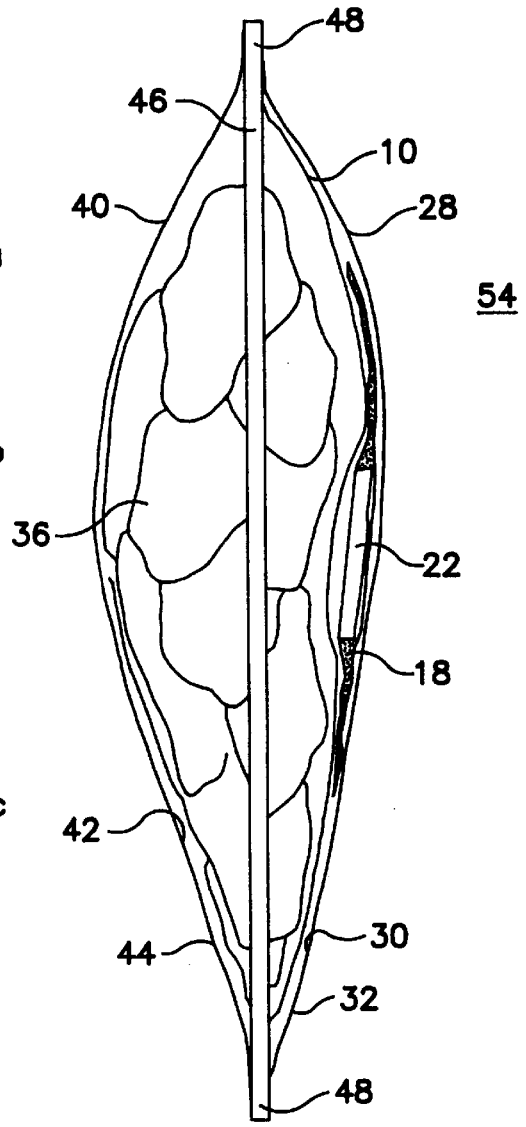
FIG. 7 is a side view illustrating the packaging according to the present invention.

As shown in FIG. 7, the final package 54, according to the preferred embodiment of the present invention, includes the first plastic sheet material 10; the adhesive layer 18 applied to the first plastic sheet material 10; the prize 22 attached to the adhesive layer 18; the second plastic sheet material 28, whose first surface 30 abuts the prize 22 and whose second surface 32 serves as an outer wall of the package 54; and the third plastic sheet material 40, whose first surface 42 faces the food 36, such as potato chips, and whose second surface 44 serves as another outer wall of the package 54.

As can be seen, this food package 54 with prize 22 is more sterile than prior art packages, since the prize 22 can be sealed between the first 10 and second 28 plastic sheet materials making up the package 54 per se. The prize 22, covered by the first plastic sheet 10, does not touch the food 36 held between the second 28 and third 40 sheet materials of the package 54. Further, one or more prizes may be easily incorporated in each individual package, as desired. Moreover, as the first sheet material 10 need only be wide enough to cover the prize 22 and adhere to the second sheet material 28, and since the adhesive layer 18 need only be applied to a part of the first sheet material 10, i.e., only enough to adhere the prize and adhere the first surface 14 to the second sheet material 28, this invention offers certain economies of raw material usage over the prior art. Also, as the prize 22 is kept internally of the package 54, the prize 22 is less susceptible to being stolen or falling off, during manufacture, shipping, storage, or retail display, a problem with the prior art package/exterior prize combinations. Of course, if desired, the plastic prize roll 26 can also be applied to the outside of conventional packaging, with the prize 22 being located between an outer sheet of the conventional packaging and the sheet 10.

The forgoing is considered illustrative only of the principles of the invention. Further, since numerous modifications and changes will readily occur to those skilled in the art, it is not desired to limit the invention to the exact construction and operation shown and described. For example, while the preferred embodiment is described above as being applicable particularly to food packaging, the invention can also be applied to other types of packaging. Accordingly, all suitable modifications and equivalents may be resorted to that fall within the scope of the invention and the appended claims.

What is claimed is:

1. A method for incorporating an object in sheet material packaging for food comprising the steps of:

(a) feeding an elongated web of a first sheet material having a first width wider than the object, a length, a first surface with adhesive formed continuously thereon for receiving the object, which has a periphery, and a second, opposite surface for contacting the food;

(b) applying the object directly to the first surface via the adhesive such that the periphery of the object is surrounded with adhesive;

(c) feeding an elongated web of a second sheet material having a second width substantially greater than the first width, such that lateral portions of the second sheet material extend beyond the first sheet material, a length, and a first surface for contacting the food and for receiving the object, wherein the length of the first sheet material is at least equal to the length of the second sheet material;

(d) opposing and adhering the first surface of the first sheet material to the first surface of the second sheet material, with the object fixedly received between and contacting the first surface via the adhesive and second surface;

(e) applying the food to the second surface of the first sheet material and to the first surface of the lateral portions of the second sheet material, such that the first surface of the second sheet material serves to both receive the object and the food, but the object and the food are prevented from commingling;

(f) sealing at least one longitudinal edge of the second sheet material, and sealing transverse areas of the second sheet material to corresponding transverse areas of the first sheet material; and (g) cutting the sealed transverse areas to form an individual package including the food and the object.

2. The method as recited in claim 1, further comprising the step of, between steps (e) and (f), feeding an elongated web of a third sheet material and attaching the third sheet material to the portions of the second sheet material, with the object, first sheet material and the food therebetween.

3. The method as recited in claim 1, further comprising the step of, between steps (e) and (f), folding the portions of the second sheet material over the object, first sheet material and the food.

4. The method as recited in claim 1, wherein the sealing step is a heat sealing step.

5. The method as recited in claim 1, wherein the sealing step comprises the substep of applying adhesive to at the least one longitudinal edge and the transverse areas.

6. The method as recited in claim 1, wherein the object is selected from candy novelties, toys, and iron-on transfers.

7. The method as recited in claim 1, wherein the first and second sheet materials are polypropylene plastic.

8. The method as recited in claim 2, wherein the third sheet material is polypropylene plastic.

9. The method as recited in claim 1, wherein the food is selected from potato chips.

* * * * *